US011543103B2

(12) United States Patent
Kemparaju et al.

(10) Patent No.: US 11,543,103 B2
(45) Date of Patent: Jan. 3, 2023

(54) LIGHT FIXTURES WITH ROTATE AND TILT CAPABILITIES

(71) Applicant: ABL IP Holding LLC, Atlanta, GA (US)

(72) Inventors: Gautham Raj Kemparaju, Peachtree City, GA (US); Stephen Howard Clark, Downers Grove, IL (US); Douglas Dewayne Grove, Grayson, GA (US)

(73) Assignee: ABL IP HOLDING LLC, Atlanta, GA (US)

( * ) Notice: Subject to any disclaimer, the term of this patent is extended or adjusted under 35 U.S.C. 154(b) by 0 days.

(21) Appl. No.: 17/167,313

(22) Filed: Feb. 4, 2021

(65) Prior Publication Data

US 2022/0243900 A1 Aug. 4, 2022

(51) Int. Cl.

| | |
|---|---|
| ***F21V 17/02*** | (2006.01) |
| ***F21V 17/10*** | (2006.01) |
| ***F21V 17/12*** | (2006.01) |
| ***F21V 21/30*** | (2006.01) |

(52) U.S. Cl.

CPC ..... *F21V 17/02* (2013.01); *F21V 17/107* (2013.01); *F21V 17/12* (2013.01); *F21V 21/30* (2013.01)

(58) Field of Classification Search

CPC ..... F21V 17/02; F21V 17/107; F21V 17/12; F21V 17/10; F21V 19/02; F21V 21/30; F21V 21/14; F21V 21/145; F21V 21/26; F21V 21/28; F21V 21/29; F21V 14/02; F21V 14/025; F21V 14/04; F21V 14/045; F21V 14/06; F21V 14/065; F21S 8/02; F21S 8/026; F21S 8/03; F21S 8/04; F21S 8/043

See application file for complete search history.

(56) References Cited

U.S. PATENT DOCUMENTS

| | | | | |
|---|---|---|---|---|
| 2,828,668 | A * | 4/1958 | De Angelis | G02C 5/2281 351/109 |
| D253,853 | S | 1/1980 | Gerber | |
| 4,919,387 | A * | 4/1990 | Sampson | F16M 11/10 248/349.1 |
| 5,289,358 | A | 2/1994 | Halemeier | |
| 5,335,142 | A * | 8/1994 | Anderson | F16M 11/10 248/183.2 |
| 5,584,574 | A * | 12/1996 | Haddad | F21V 11/00 362/280 |
| 6,082,878 | A * | 7/2000 | Doubek | F21S 8/026 211/26 |
| D592,791 | S | 5/2009 | Sabernig | |
| D603,552 | S | 11/2009 | Kampe | |

(Continued)

FOREIGN PATENT DOCUMENTS

JP 2008218188 A * 9/2008

OTHER PUBLICATIONS

Kengo, Luminaire, Sep. 18, 2008, JP-2008218188-A (Year: 2008).*

*Primary Examiner* — Jong-Suk (James) Lee
*Assistant Examiner* — James M Endo
(74) *Attorney, Agent, or Firm* — Kilpatrick Townsend & Stockton LLP

(57) ABSTRACT

A light fixture having an upper housing and a lower housing. A rotate-tilt mechanism is interposed between the two housings to permit the lower housing both to rotate and tilt relative to the upper housing.

22 Claims, 7 Drawing Sheets

(56) References Cited

U.S. PATENT DOCUMENTS

| | | | | |
|---|---|---|---|---|
| 7,762,688 | B2 | 7/2010 | Dixon et al. | |
| D655,841 | S | 3/2012 | Coleman, Jr. | |
| 8,182,120 | B1 * | 5/2012 | Wronski | F21S 8/02 362/365 |
| D664,279 | S | 7/2012 | Meise et al. | |
| 8,360,621 | B2 * | 1/2013 | Avila | F21V 21/28 362/419 |
| D697,245 | S | 1/2014 | Thomas et al. | |
| 9,239,149 | B2 * | 1/2016 | Vice | F21V 21/30 |
| D753,328 | S | 4/2016 | Mathews et al. | |
| 9,593,829 | B2 | 3/2017 | Dupre et al. | |
| D787,108 | S | 5/2017 | Hendifar et al. | |
| D799,736 | S | 10/2017 | Hendifar et al. | |
| 10,088,134 | B1 * | 10/2018 | Helms | F21V 33/006 |
| 10,113,726 | B1 * | 10/2018 | Veloskey | F21V 21/30 |
| 10,267,498 | B2 * | 4/2019 | Carroll | F21V 21/08 |
| 10,371,329 | B2 * | 8/2019 | Coakley | F21V 23/026 |
| 10,732,487 | B2 * | 8/2020 | Miyakawa | F21V 21/30 |
| 2006/0146536 | A1 | 7/2006 | Laenen et al. | |
| 2007/0171655 | A1 * | 7/2007 | Lai | F21V 21/0824 362/362 |
| 2009/0296412 | A1 * | 12/2009 | Ogawa | F21V 23/005 362/373 |
| 2013/0163243 | A1 | 6/2013 | Reed | |
| 2013/0170232 | A1 | 7/2013 | Park et al. | |
| 2014/0204574 | A1 * | 7/2014 | Ebisawa | F21V 14/02 362/235 |
| 2014/0313727 | A1 * | 10/2014 | Dupre | F21V 21/30 362/287 |
| 2017/0198887 | A1 * | 7/2017 | Veloskey | F21V 17/02 |
| 2018/0023790 | A1 * | 1/2018 | Johnson | F21V 31/005 362/427 |
| 2018/0340646 | A1 * | 11/2018 | Mehdi | H04N 7/181 |

* cited by examiner

LIGHT FIXTURES WITH ROTATE AND TILT CAPABILITIES

FIELD OF INVENTION

The present technology relates to light fixtures, and more particularly to light fixtures that can rotate and tilt to control the directionality of light emitted from the light fixture.

DESCRIPTION OF THE RELATED ART

Mounted light fixtures are used in residential and commercial locations and may be used for various illumination purposes, including wall wash illumination, accent lighting of a specific object, and general ambient illumination. Mounted light fixtures are often desirable because they do not take up valuable floor space, as compared for example with floor lamps.

Pendant-style light fixtures can be a design choice due to their aesthetics or appearance. However, pendant-style fixtures can suffer from limited control over how the emitted light is directed. To circumvent the problem of control, additional pendant fixtures can be added in an installation to generate more light. However, adding additional fixtures does not always address the issue of full lighting control.

BRIEF SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Embodiments of the present invention relate to a light fixture having an upper housing and a lower housing. A rotate-tilt mechanism is interposed between the two housings to permit the lower housing both to rotate and tilt relative to the upper housing.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Throughout this description for the purposes of explanation, numerous specific details are set forth in order to provide a thorough understanding of the many aspects and embodiments disclosed herein. It will be apparent, however, to one skilled in the art that the many aspects and embodiments may be practiced without some of these specific details. In other instances, known structures and devices are shown in diagram or schematic form to avoid obscuring the underlying principles of the described aspects and embodiments.

Figure 1A:
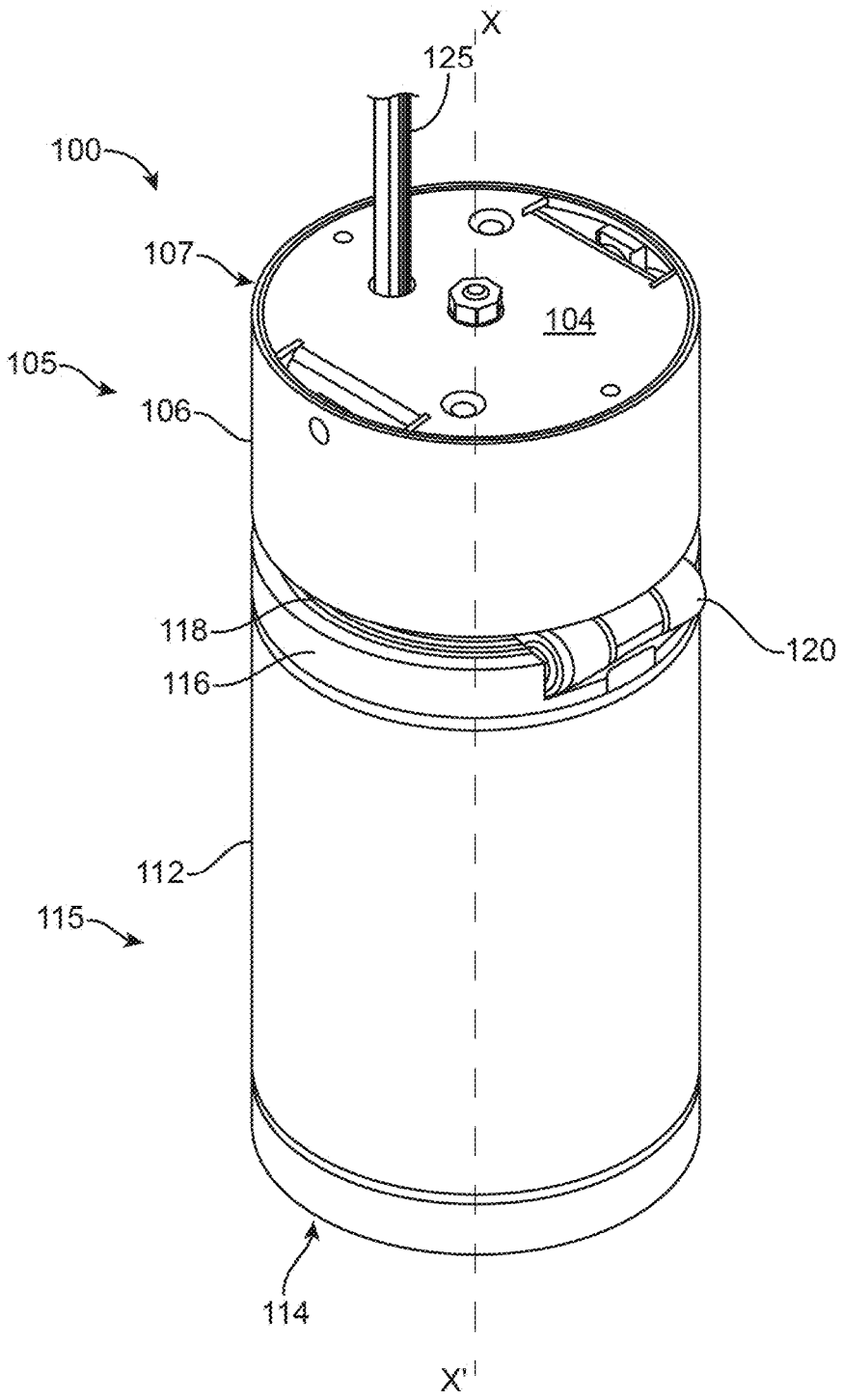
FIG. 1A shows a perspective view of a pendant light fixture with the upper and lower housing in an aligned orientation, according to embodiments.
Figure 1B:
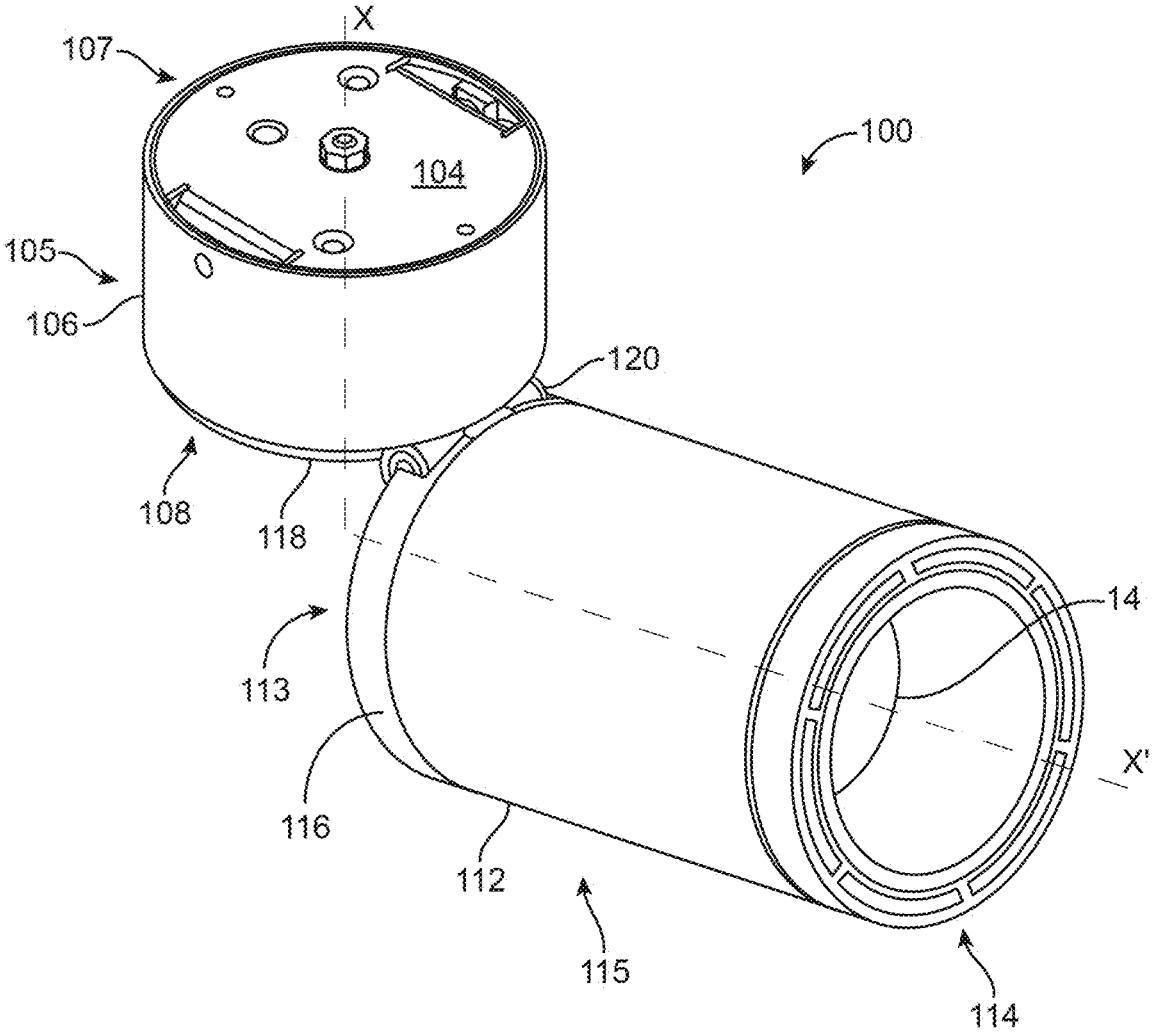
FIG. 1B shows the pendant light fixture of FIG. 1A with the lower housing tilted at an angle of tilt relative to the upper housing, according to embodiments.

FIGS. 1A and 1B show one embodiment of a pendant mount light fixture 100 provided with a rotate-tilt mechanism. The light fixture 100 generally includes an upper housing 105 and a lower housing 115 positioned below the upper housing 105. While the upper housing 105 and lower housing 115 are illustrated as having substantially cylindrical outer cross-sections that align or substantially align, the light fixture 100 may have any desirable shape, including, but not limited to, a square or rectangular shape. Moreover, the light fixture 100 can be suspended from a ceiling, such as via a cable or other suspension mounting means. However, in other embodiments, the light fixture 100 can be mounted flush with a surface, such as a ceiling surface.

Figure 2:
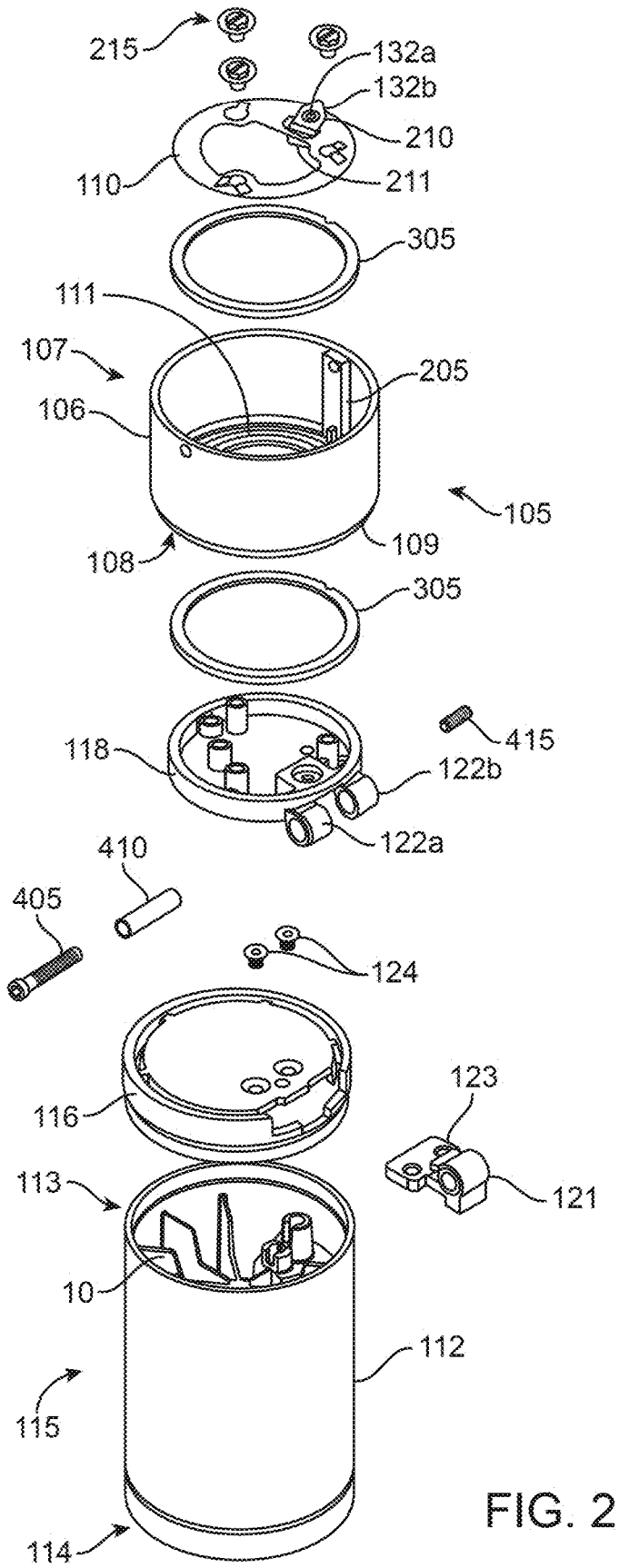
FIG. 2 shows a partial exploded view of the pendant light fixture of FIG. 1A, according to embodiments.
Figure 5:
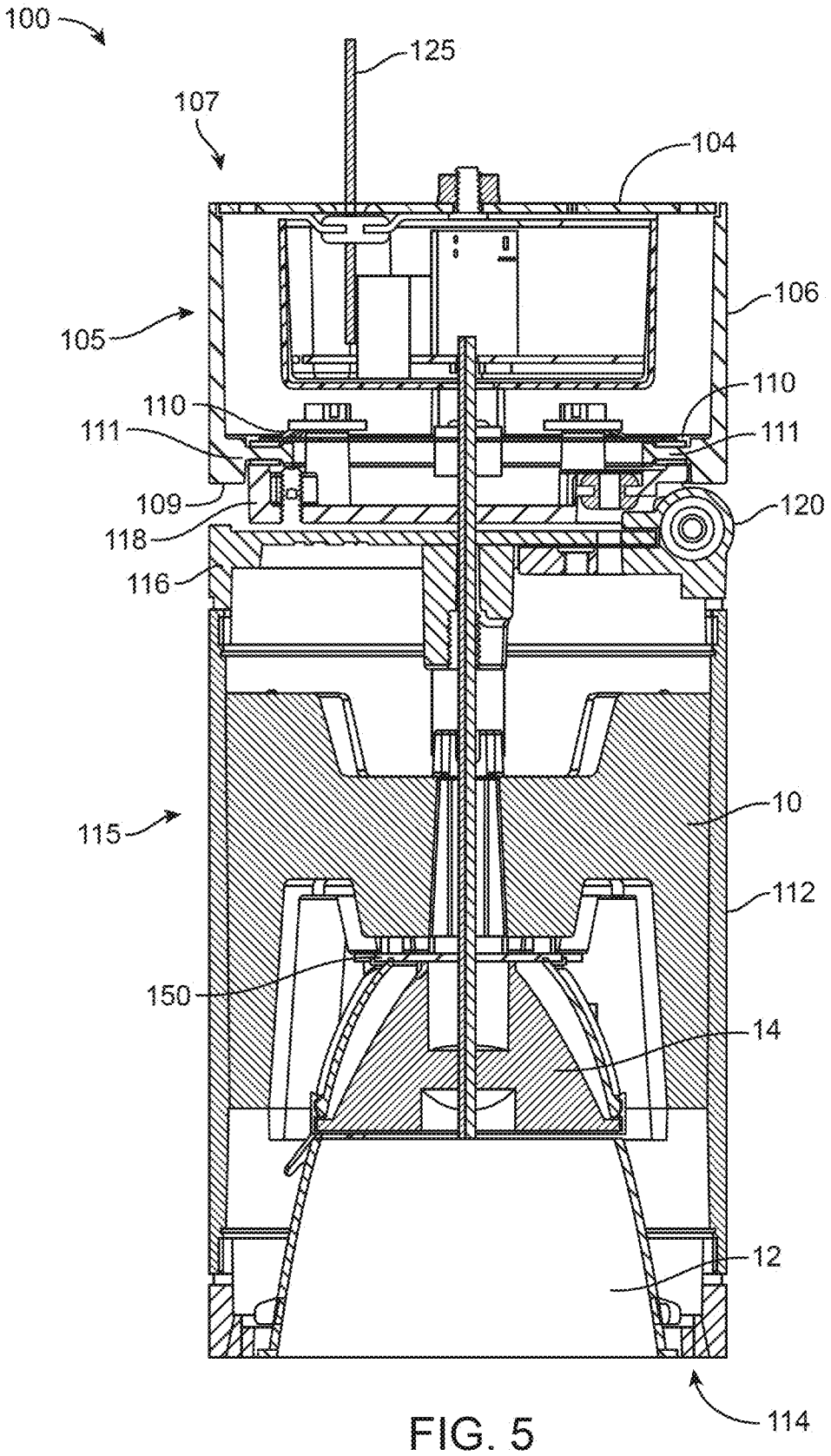
FIG. 5 shows a vertical cross section across the center of the pendant light fixture of FIG. 1A, according to embodiments.

With reference to FIGS. 1A, 1B, and 2, the upper housing 105 extends along an upper housing axis x and includes an upper body 106 having an upper end 107, a lower end 108, and a lower edge 109. A cover plate 104 may be provided to enclose the upper end 107 of the upper body 106. A ledge 111 (the purpose of which is described below) extends inwardly from the inner surface of the upper body 106. The ledge 111 can be continuous or may be provided in the form of ledge segments. Moreover, the ledge 111 will typically be provided proximate the lower end 108 of the upper housing 105 but may be provided in any location along the height of the upper body 106. As best seen in FIGS. 2 and 5, the ledge 111 is recessed slightly from the lower edge 109 such that a gap is formed between the ledge 111 and the lower edge 109, but the ledge 111 could also extend co-planar/flush with the lower edge 109 or be recessed further upwardly within the upper body 106 such that the gap becomes larger.

The upper housing 105 will typically house the electronics/electrical components for powering the light sources housed in the lower housing 115 of the light fixture 100. Electrical wires 125 route from the ceiling (typically from an electrical box, junction box, or any suitable power source) through the upper housing 105 and into the lower housing 115 to power the light source(s).

The lower housing 115 has a lower housing axis x' and includes a lower body 112 having an upper end 113 and a lower end 114. In the illustrated embodiment, a top cap 116 is provided on the upper end 113 of the lower body 112 to enclose the upper end 113. The top cap 116 may be secured to the lower body 112 using any suitable means (threads, fasteners, adhesives, latches, etc.). However, a separate top cap need not be used to enclose the upper end 113 of the lower housing 115. Rather, a top wall may be formed integrally with the lower body 112 so as to enclose the upper end 113 of the lower housing 115.

As best seen in FIG. 5, the lower housing 115 houses one or more light sources (denoted generally by 150) that generate and emit light from the lower end 114 of the lower housing 115. One or more apertures are provided in the top cap 116 through which electrical wires may extend to power the light sources. Additional components for thermal management (e.g. heat sink 10) and lighting control (reflectors 12, lenses/optics 14, etc.) may be provided in the lower housing 115, the specifics of which are not germane to the present disclosure. Rather, the lower housing 115 may house any type and arrangement of light sources and other components provided that light is emitted from the lower end 114 of the lower housing 115.

A rotate-tilt mechanism is interposed between the upper housing 105 and the lower housing 115 to facilitate both rotation and tilting of the lower housing 115 relative to the upper housing 105. In some embodiments, the rotate-tilt mechanism includes a rotation plate 110 that is rotatably supported by the ledge 111 of the upper housing 105 and a tilt plate 118 that (i) fixedly connects to the rotation plate 110 and (ii) pivotably connects to the lower housing 115. In this way, the rotate-tilt mechanism (and thus the lower housing 115 connected to it) can rotate relative to the upper housing 105 and the lower housing 115 can pivot or tilt relative to the rotate-tilt mechanism (see FIG. 1B), thus permitting movement of the lower housing 115 about two degrees of freedom to enhance control of the direction of the light emitted from the light fixture 100.

Figure 3:
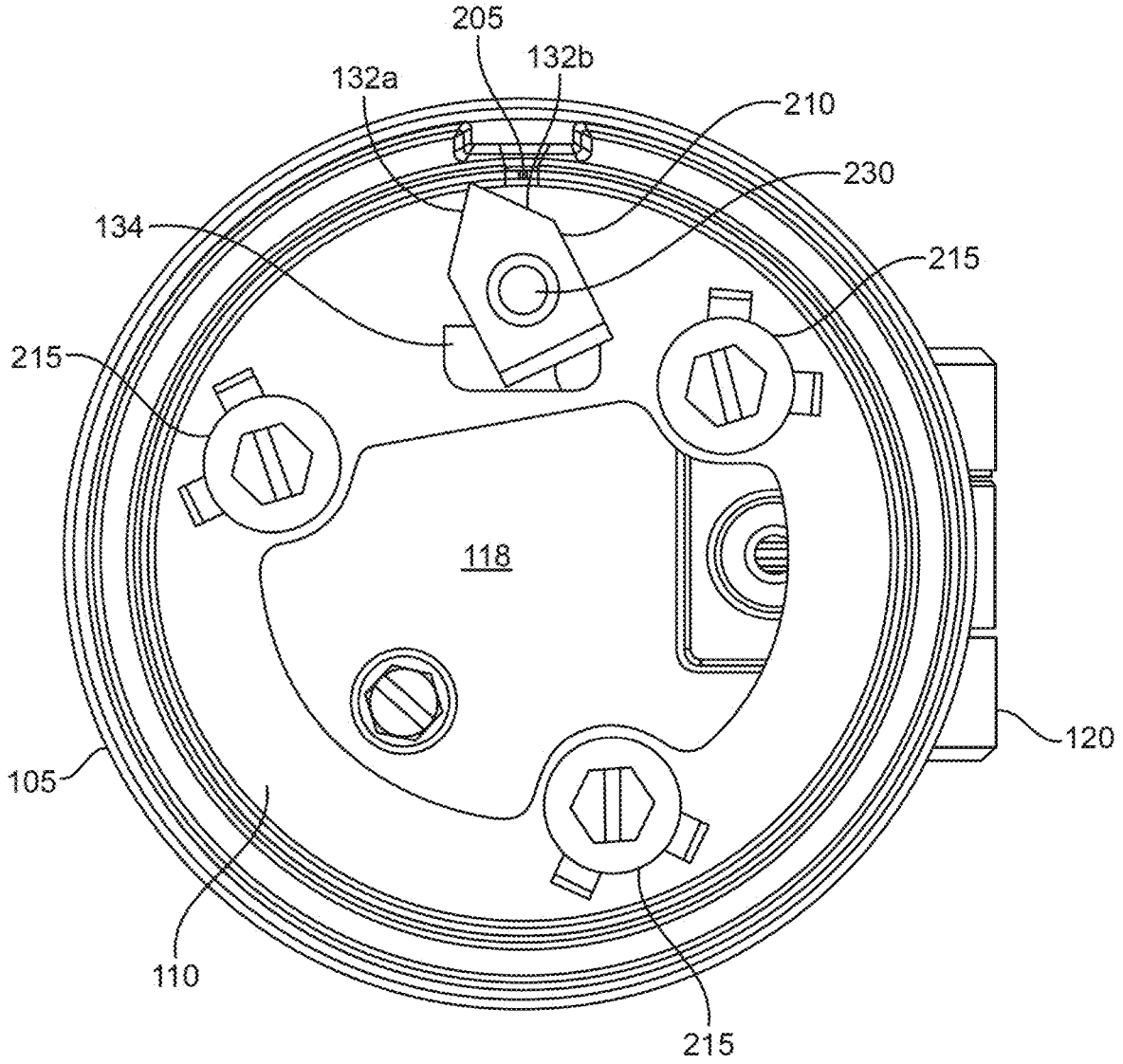
FIG. 3 shows a top plan view of the pendant light fixture of FIG. 1A with the cover plate removed, according to embodiments.

FIG. 3 shows a partial exploded view of the light fixture 100. Rotation plate 110 has an upper surface and a lower surface that seats on ledge 111 within upper housing 105 (see also FIG. 4). Tilt plate 118 is attached below the upper housing 105 so as to effectively enclose the lower end 108 of the upper housing 105 and such that the ledge 111 is sandwiched between the rotation plate 110 and the tilt plate 118. More specifically, fasteners 215 may be inserted through apertures in the rotation plate 110 and engage bosses provided on the tilt plate 118. In the illustrated embodiment of FIG. 5, an upper portion of the tilt plate 118 is received within the gap formed between the lower edge 109 and ledge 111 of the upper housing 105.

Securing the rotation plate 110 and tilt plate 118 to each other secures the tilt plate 118 to the upper housing 105. However, it should be noted that the rotation plate 110 and the tilt plate 118, which are fixedly secured to each other, are able to rotate in unison relative to the upper housing 105.

One or more polymeric rings 305 (such as, but not limited to, nylon rings) can be positioned between the rotate-tilt mechanism (rotation plate 110 and/or tilt plate 118) and the upper housing 105 (more specifically, the ledge 111 of the upper housing 105) to aid in smooth rotation of the rotation plate 110 and/or tilt plate 118. For example, the polymeric rings 305 may prevent metal-to-metal contact that could impede rotation.

Figure 4:
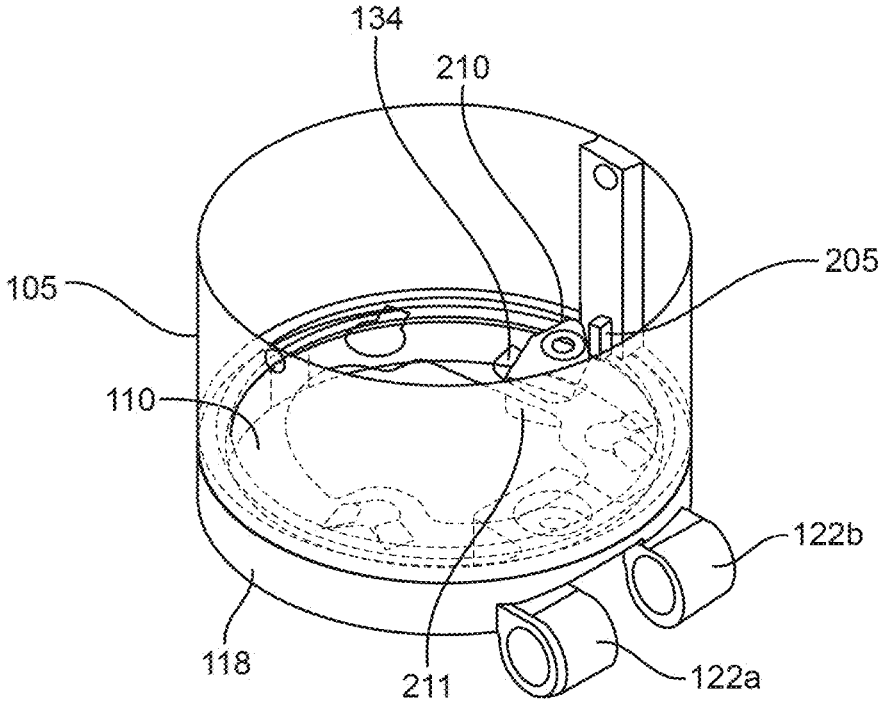
FIG. 4 shows a perspective view of the rotate-tilt mechanism positioned within the upper housing, according to embodiments.

As seen in FIGS. 2-4, an arm 210 is mounted or otherwise provided on rotation plate 110. The purpose of the arm 210 is to prevent the rotation plate 110 from being allowed to rotate continuously relative to the upper housing 105. In the illustrated embodiment, the arm 210 is in the form of a tapered arm having two angled distal edges 132*a*, 132*b*. Note that other arm 210 geometries are contemplated herein. The arm 210 is attached to the rotation plate 110 and able to rotate about pivot point 230. However, in some embodiments the arm 210 is only permitted to rotate about pivot point 230 to a certain degree, such as between +15° and −15° relative to a resting position of the arm 210. For example, when the arm 210 engages the rotation stop 205, it can pivot up to 15° about pivot point 230 to permit continued rotation of rotation plate 110 slightly beyond the point where the arm 210 initially engaged the rotation stop 205. In the illustrated embodiment, the arm 210 includes a tail 211 that extends from the tapered arm and that is received within an aperture 134 in the rotation plate 110. The relative size and shape of the tail 211 and aperture 134 permit the arm 210 to pivot only to a certain extent before the tail 211 will abut the rotation plate 110, thus preventing further pivoting of the arm 210. However, other means by which to limit pivoting of the arm 210 are certainly contemplated herein.

When the rotation plate 110 is seated on the ledge 111 within the upper housing 105, the distal end of the arm 210 extends laterally outwardly from the rotation plate 110. The rotation plate 110 is free to rotate within the upper housing 105 (clockwise or counterclockwise) until a distal edge 132*a*, 132*b* of the arm 210 contacts a rotation stop 205 provided along the inner wall of the upper housing 105 (best seen in FIG. 4). Thus, the arm 210 is able to rotate between opposing sides of the rotation stop 205 but not fully across the rotation stop 205 so as to prevent continuous rotation of the rotation plate 110 (either clockwise or counter-clockwise). When the arm 210 contacts the rotation stop 205, exertion of additional rotational force will result in the arm 210 pivoting about pivot point 230, thus allowing the arm 210 to move slightly beyond the abutting side of the rotation stop 205. In some embodiments, this allows the rotation plate 110 (and thus the lower housing 115 connected to it as explained below) to rotate slightly beyond 360° within the upper housing 105. In some embodiments, the rotation plate 110 is able rotate up to 365° (in either or both of the clockwise and counter-clockwise directions) relative to the upper housing 105.

The lower housing 115 is pivotably attached to the tilt plate 118 with a hinge joint 120. It is notable that the hinge is an integrated hinge that is formed directly with the tilt plate 118. More specifically, at least one hinge knuckle is formed with the tilt plate 118 and at least one hinge knuckle is provided on the lower housing 115. A hinge fastener 405 is positioned within the aligned apertures of the hinge knuckles to form the hinge joint 120. In the illustrated embodiments, two hinge knuckles 122*a*, 112*b* are provided on the tilt plate 118. A knuckle bracket 123 with knuckle 121 is attached is to lower housing 115 (and more specifically on the top cap 116 of the lower housing 115). In the illustrated embodiment, screws 124 engage apertures in the knuckle bracket 123 and top cap 116 to secure the knuckle bracket 123 to the top cap 116 (and thus to the lower housing 115). Note, however, that it is contemplated that knuckle 121 could be secured using other techniques or could be formed integrally on the top cap 116 or on the lower body 112. The hinge joint 120 permits the lower housing 115 to pivot or tilt relative to the tilt plate 118 (and thus relative to the upper housing 105).

In some embodiments, the hinge joint 120 can maintain an angle of tilt of the lower housing 115, such that, when the lower housing 115 is positioned at a particular angle of tilt, the hinge joint 120 prevents the lower housing 115 from slipping or dropping due to the effects of gravity or the weight of the lower housing 115. By way only of example, in the illustrated embodiment, a nylon bushing 410 is provided in the aperture of the hinge joint 120. The hinge fastener 405 is screwed into the nylon bushing 410 and bears against the nylon bushing 410, which in turn helps to resist further movement of the hinge joint 120. Thus, in some embodiments the nylon bushing 410 can provide sufficient friction within the hinge joint 120 such that the lower housing 115 can maintain a tilt position.

Figure 6:
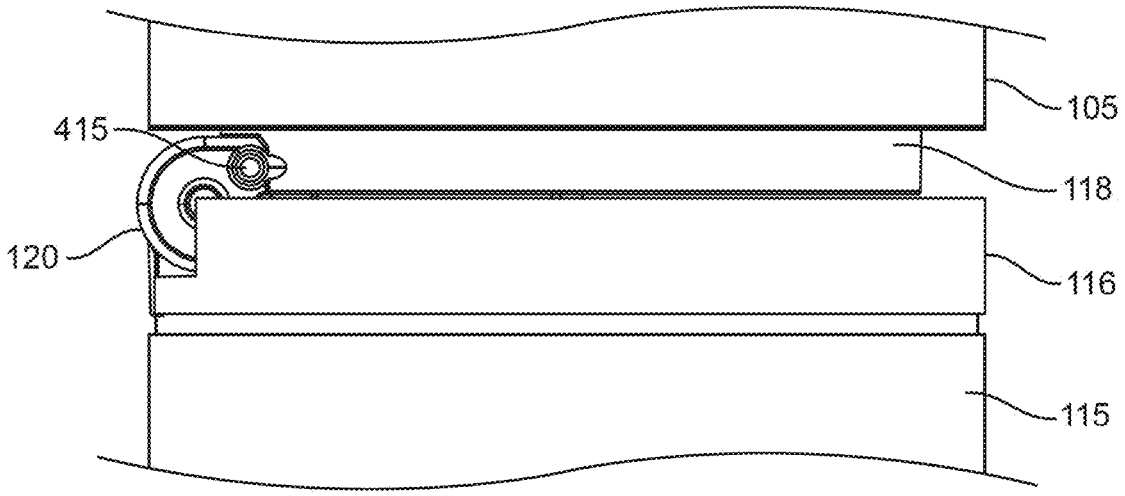
FIG. 6 shows a partial side elevation view of the pendant light fixture of FIG. 1A, according to embodiments.

Additional locking features may be provided on the hinge joint 120 to maintain the tilt angle. By way only of example and as seen in FIG. 6, a locking screw 415 may be inserted into an aperture in the hinge joint 120. The end of the locking screw 415 may bear against a portion of the hinge joint 120 (such as the outer surface of knuckle 121) to rotationally lock the hinge joint 120.

When the lower housing 115 is hingedly connected to the tilt plate 118, it should be noted that the lower housing 115 is not directly attached to the upper housing 105 but instead is indirectly connected to the upper housing 105 via the rotate-tilt mechanism. Thus, the lower housing 115 is free to rotate and tilt relative to the upper housing 105. More specifically, rotation of the lower housing 115 results in rotation of the rotation plate 110 relative to the upper housing 105. As described above, in some embodiments rotation plate 110 (and thus lower housing 115) is able to rotate up to 365° in the clockwise and counter-clockwise directions relative to the upper housing 105.

Moreover, by virtue of the hinge joint 120, the lower housing 115 is able to tilt relative to the tilt plate 118 (and thus also the upper housing 105). In some embodiments, the range of tilt is from 0° to 100°, inclusive; however, a range of tilt between 0° to 90°, inclusive, will be suitable for most applications. As seen in FIG. 1A, when the tilt angle is 0°, the lower housing axis x' will typically be aligned with the upper housing axis x and directionality of the light emitted from the lower housing 115 will generally be aligned with those axes. In such instances, the emitted light will often be directed directly downwardly from a light fixture mounted on a ceiling. As seen in FIG. 1B, when the tilt angle is 90°, the lower housing axis x' will extend perpendicular to the upper housing axis x such that the emitted is directed substantially horizontally relative to the upper housing 105.

In this way, the lower housing 115 can be manipulated—both rotationally and tiltably—to permit quick and easy adjustment to the directionality of light emitted from the light fixture 100.

The various aspects, embodiments, implementations or features of the described embodiments can be used separately or in any combination. In particular, it should be appreciated that the various elements of concepts from FIGS. 1A-6 may be combined without departing from the spirit or scope of the invention.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, or gradients thereof, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained.

Preferred embodiments of this invention are described herein, including the best mode known to the inventors for carrying out the invention. The invention is susceptible to various modifications and alternative constructions, and certain shown exemplary embodiments thereof are shown in the drawings and have been described above in detail. Variations of those preferred embodiments, within the spirit of the present invention, may become apparent to those of ordinary skill in the art upon reading the foregoing description. The inventors expect skilled artisans to employ such variations as appropriate, and the inventors intend for the invention to be practiced otherwise than as specifically described herein. Accordingly, it should be understood that there is no intention to limit the invention to the specific form or forms disclosed, but on the contrary, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context. The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A light fixture comprising:

an upper housing having an upper housing axis, an upper end, a lower end, and a ledge that extends inwardly from an inner surface of the upper housing more proximate the lower end than the upper end of the upper housing;

a rotation plate supported within the upper housing by the ledge and configured to rotate relative to the upper housing along a rotation path and about the upper housing axis;

a tilt plate adapted to enclose the lower end of the upper housing and having an outer lateral wall from which an integral first hinge portion laterally extends, wherein the tilt plate is fixedly attached to the rotation plate so as to rotate in unison with the rotation plate and wherein the tilt plate is positioned below the upper housing such that the ledge is interposed between the rotation plate and the tilt plate; and a lower housing having a lower housing axis, an upper end, and a lower end, wherein the lower housing: (i) comprises at least one light source configured to emit light from the lower end of the lower housing; (ii) comprises a second hinge portion that cooperates with the first hinge portion to form a hinge joint that pivotably connects the lower housing to the tilt plate; and (iii) is configured to rotate in unison with the rotation plate and pivot about the hinge joint from a first tilt orientation where the upper housing axis and the lower housing axis are aligned to a second tilt orientation wherein the lower housing axis is angularly offset from the upper housing axis.

2. The light fixture of claim 1, wherein the rotation plate is able to rotate from 0° to up to 365° relative to the upper housing.

3. The light fixture of claim 1, wherein the upper housing further comprises a rotation stop provided in the rotation path of the rotation plate to prevent continuous rotation of the rotation plate relative to the upper housing.

4. The light fixture of claim 3, wherein the rotation plate further comprises an arm pivotably connected to the rotation plate such that the arm can rotate relative to the rotation plate, wherein the arm is configured to rotate upon engagement with the rotation stop.

5. The light fixture of claim 4, wherein the rotation plate is able to rotate from 0° to up to 365° relative to the upper housing.

6. The light fixture of claim 4, wherein the arm is configured to rotate between −15° and +15° upon engagement with the rotation stop.

7. The light fixture of claim 4, wherein the arm comprises a body portion and a tail portion, wherein the body portion is configured to engage the rotation stop and is pivotably connected to the rotation plate, wherein the tail portion extends from the body portion and is received in an aperture defined in the rotation plate, and wherein the tail portion and the aperture are configured to allow the body portion to rotate up to 30° relative to the rotation plate.

8. The light fixture of claim 1, further comprising at least one polymeric ring interposed between the ledge and at least one of the rotation plate or the tilt plate.

9. The light fixture of claim 1, wherein the tilt plate is fixedly attached to the rotation plate by at least one set screw.

10. The light fixture of claim 1, wherein the hinge joint is configured to maintain the lower housing at the second tilt orientation.

11. The light fixture of claim 10, wherein the hinge joint further comprises a nylon bushing and a hinge fastener received within the nylon bushing.

12. The light fixture of claim 10, wherein the hinge joint further comprises a locking aperture and a locking screw configured to prevent relative rotation between the first hinge portion and the second hinge portion when positioned within the locking aperture.

13. The light fixture of claim 1, wherein the upper housing and the lower housing are substantially cylindrical in shape.

14. The light fixture of claim 1, wherein the light fixture is configured to be suspended from a mounting surface by the upper housing.

15. The light fixture of claim 1, wherein the upper housing of the light fixture is configured to be mounted substantially flush with a mounting surface.

16. A light fixture comprising:

an upper housing having an upper housing axis, an upper end, a lower end, a ledge that extends inwardly from an inner surface of the upper housing more proximate the lower end than the upper end of the upper housing, and a rotation stop;

a rotation plate supported within the upper housing by the ledge and configured to rotate relative to the upper housing along a rotation path and about the upper housing axis, wherein the rotation plate comprises an arm pivotably connected to the rotation plate so as to be able to rotate relative to the rotation plate and wherein the rotation stop of the upper housing is provided in the rotation path of the rotation plate such that the arm engages the rotation stop and is configured to rotate relative to the rotation plate to permit the rotation plate to rotate up to approximately 365° relative to the upper housing;

a tilt plate adapted to enclose the lower end of the upper housing and having an outer lateral wall from which an integral first hinge portion laterally extends, wherein the tilt plate is fixedly attached to the rotation plate so as to rotate in unison with the rotation plate and wherein the tilt plate is positioned below the upper housing such that the ledge is interposed between the rotation plate and the tilt plate; and a lower housing having a lower housing axis, an upper end, and a lower end, wherein the lower housing: (i) comprises at least one light source configured to emit light from the lower end of the lower housing; (ii) comprises a second hinge portion that cooperates with the first hinge portion to form a hinge joint that pivotably connects the lower housing to the tilt plate; and (iii) is configured to rotate in unison with the rotation plate and pivot about the hinge joint from a first tilt orientation where the upper housing axis and the lower housing axis are aligned to a second tilt orientation wherein the lower housing axis is angularly offset from the upper housing axis, wherein the hinge joint is configured to maintain the lower housing at the second tilt orientation.

17. The light fixture of claim 16, wherein the hinge joint comprises a locking aperture and a locking screw configured to prevent relative rotation between the first hinge portion and the second hinge portion when positioned within the locking aperture.

18. The light fixture of claim 16, wherein the hinge joint further comprises a nylon bushing and a hinge fastener received within the nylon bushing.

19. The light fixture of claim 16, wherein the arm is configured to rotate between −15° and +15° relative to the rotation plate.

20. The light fixture of claim 16, further comprising at least one polymeric ring interposed between the ledge and at least one of the rotation plate or the tilt plate.

21. The light fixture of claim 16, wherein the tilt plate is fixedly attached to the rotation plate by at least one set screw.

22. A light fixture comprising:

an upper housing having an upper housing axis, an upper end, a lower end, and a ledge that extends inwardly from an inner surface of the upper housing more proximate the lower end than the upper end of the upper housing;

a rotation plate supported within the upper housing by the ledge and configured to rotate relative to the upper housing along a rotation path and about the upper housing axis;

a tilt plate comprising an integral first hinge portion, wherein the tilt plate is fixedly attached to the rotation plate so as to rotate in unison with the rotation plate and wherein the tilt plate is positioned below the upper housing such that the ledge is interposed between the rotation plate and the tilt plate; and a lower housing having a lower housing axis, an upper end, and a lower end, wherein the lower housing: (i) comprises at least one light source configured to emit light from the lower end of the lower housing; (ii) comprises a second hinge portion that cooperates with the first hinge portion to form a hinge joint that pivotably connects the lower housing to the tilt plate; and (iii) is configured to rotate in unison with the rotation plate and pivot about the hinge joint from a first tilt orientation where the upper housing axis and the lower housing axis are aligned to a second tilt orientation wherein the lower housing axis is angularly offset from the upper housing axis, wherein the upper housing further comprises a rotation stop provided in the rotation path of the rotation plate to prevent continuous rotation of the rotation plate relative to the upper housing, wherein the rotation plate comprises an arm pivotably connected to the rotation plate such that the arm can rotate relative to the rotation plate, wherein the arm is configured to rotate upon engagement with the rotation stop, and wherein the arm comprises a body portion and a tail portion, wherein the body portion is configured to engage the rotation stop and is pivotably connected to the rotation plate, wherein the tail portion extends from the body portion and is received in an aperture defined in the rotation plate, and wherein the tail portion and the aperture are configured to allow the body portion to rotate up to 30° relative to the rotation plate.

* * * * *